US006883928B2

(12) United States Patent
Kahn

(10) Patent No.: US 6,883,928 B2
(45) Date of Patent: Apr. 26, 2005

(54) EASILY-ACCESSIBLE MULTI-SIGNAL LIGHT FOR A CHAIR POSITIONED AT A GAMING TABLE IN A CASINO

(75) Inventor: Paul L. Kahn, Culver City, CA (US)

(73) Assignee: Arlen B. Kahn, Sherman Oaks, CA (US)

( * ) Notice: Subject to any disclaimer, the term of this patent is extended or adjusted under 35 U.S.C. 154(b) by 13 days.

(21) Appl. No.: 10/645,929

(22) Filed: Aug. 20, 2003

(65) Prior Publication Data

US 2005/0041416 A1 Feb. 24, 2005

(51) Int. Cl.[7] ..... F21V 33/00
(52) U.S. Cl. ..... 362/131; 362/184; 362/251; 362/418
(58) Field of Search ..... 362/127, 131, 362/184, 191, 231, 237, 240, 251, 287, 418, 362/421; 297/217.6

(56) References Cited

U.S. PATENT DOCUMENTS 1,704,415 A * 3/1929 Wenegrat ..... 297/217.6
1,953,451 A * 4/1934 Watkons ..... 362/131
1,955,916 A * 4/1934 Irminger ..... 362/131
2,744,997 A * 5/1956 Sefsik et al. ..... 297/217.3
3,729,627 A * 4/1973 Littell ..... 362/131
3,868,671 A * 2/1975 Maguire et al. ..... 362/184
3,897,141 A * 7/1975 Schocket ..... 362/131
4,233,649 A * 11/1980 Scheer et al. ..... 362/131

* cited by examiner

*Primary Examiner*—Y. My Quach-Lee
(74) *Attorney, Agent, or Firm*—Eric K. Satermo

(57) ABSTRACT

A signal light for a chair positioned at a gaming table in a casino. The signal light includes a light housing and a switch housing. A power supply may also be included. The light housing is disposed or mounted on a support which is mounted to the chair such that the light housing is elevated above the chair. The switch housing is operatively connected to the light housing such that the switch housing is spatially separated the light housing. The light housing may include a plurality of differently colored lights that a casino may designate for respective services when lit, and the switch housing may include a corresponding number of switches for selectively operating the lights.

30 Claims, 4 Drawing Sheets

EASILY-ACCESSIBLE MULTI-SIGNAL LIGHT FOR A CHAIR POSITIONED AT A GAMING TABLE IN A CASINO

BACKGROUND OF THE INVENTION

The present invention relates lighting devices and, more particularly, to lighting devices having a plurality of colored lights.

In a casino environment, gaming tables are arranged with seating for customers and a gaming employee, for example, a blackjack dealer. During the course of gaming, customers may require various services performed by particular casino employees, such as a cashier, a waitress, a pit boss, and so on. To receive these services, the customer usually informs the dealer of his or her needs who, in turn, looks for the particular employee and provides a verbal or a physical (e.g., a wave) signal. In securing these services, the dealer's attention is distracted from the game at hand: eyes are diverted from the table when a head is turned away from the action to look for the particular service employee.

In the interest of security and fair play, casinos minimize the amount of items or apparatus on a gaming table to only those items absolutely necessary to perform the game. Nothing is superfluous and nothing is added that may distract the dealer running the table. In addition, nothing is positioned above the tables so that there are no obstructions for the video cameras monitoring the activity.

In view of this gaming environment, casinos find it desirable to minimize as much as possible the level of distraction to the gaming table-employee running a game on a particular table.

BRIEF SUMMARY OF THE INVENTION

According to one aspect of the invention, a signal light for a chair positioned at a gaming table in a casino includes a light housing and a switch housing. A power supply may also be included. The light housing is disposed or mounted on a support which is mounted to the chair such that the light housing is elevated above the chair. The switch housing is operatively connected to the light housing such that the switch housing is spatially separated the light housing. The switch housing may also be operatively connected to the light housing such that the switch housing is easily accessible to a person sitting in the chair. The light housing may include a plurality of differently colored lights that a casino may designate for respective services when lit, and the switch housing may include a corresponding number of switches for selectively operating the lights.

In contrast to the current casino environment, the signal light of the invention enables dealers and other gaming-table employees to respond to customers requests for service in an efficient and non-distracting manner. Indeed, to access the switch housing, a dealer need not divert his or her eyes from the action at hand but rather reach to the know position of the switch housing. In addition, the light of the invention enables current dealer chairs in a casino to be retrofitted so that the casino does not need to invest in an entire new set of dealer chairs.

Other features and advantages of the present invention will become apparent to those skilled in the art from a consideration of the following detailed description taken in conjunction with the accompanying drawings.

DETAILED DESCRIPTION OF THE INVENTION

Figure 1:
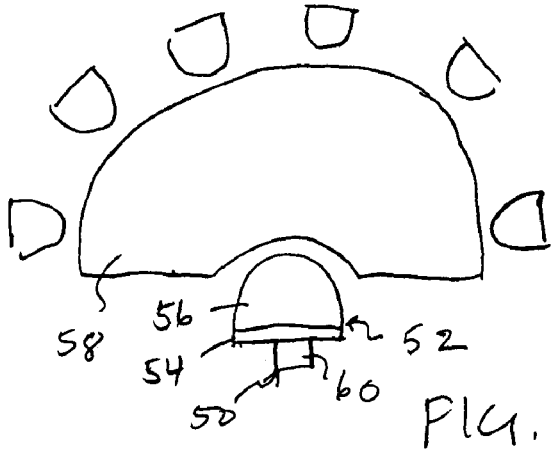
FIG. 1 is a plan view of a casino gaming table with an employee's chair positioned thereat with a signal light.
Figure 2:
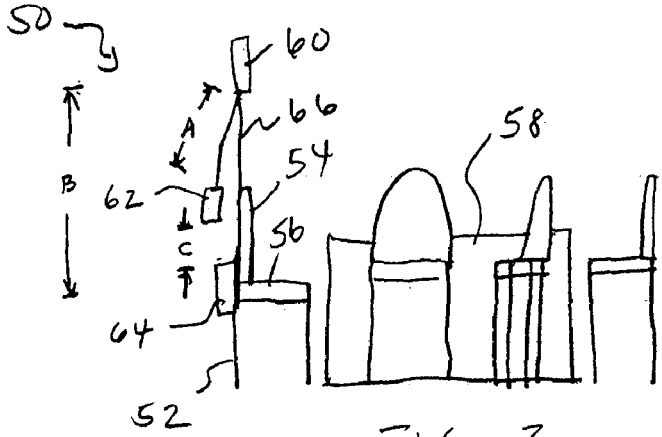
FIG. 2 is an elevation view of the casino gaming table of FIG. 1.

Referring more particularly to the drawings, a signal light 50 for a chair 52 with a back 54 and a seat 56 and positioned at a gaming table 58 is illustrated in FIGS. 1 and 2. In a number of embodiments, the signal light 50 includes a light housing 60 and a switch housing 62. In other embodiments, the light housing 60 may include a power supply 64. The light housing 60 is disposed or mounted on a support 66 which is mounted to the chair 52 such that the light housing 60 is elevated above the chair 52 as particularly shown in FIG. 2. The switch housing 62 is operatively connected to the light housing 60 such that the switch housing 62 is spatially separated the light housing 60. This spatial separation of the housings 60 and 62 is indicated by alpha A in FIGS. 2 and 3. In a number of embodiments, the light housing 60 may include a plurality of differently colored lights that a casino may designate for respective services when lit, which will be discussed in more detail below. In still other embodiments, the switch housing 62 may be moved and positioned with respect to the light housing 60.

In a number of embodiments, the support 66 may be configured so that the light housing 60 is elevated a couple of feet above the back of the chair 52; accordingly, the light housing 60 may be positioned above the head of a person sitting in the chair 52. In other embodiments, the support 66 may be configured so that the light housing 60 is elevated several feet over the chair 52; accordingly, the light housing 60 may be a vantage point over the heads of people standing on the floor around the chair 52 so that persons can view the light housing 60 from a distance without obstruction. Therefore, depending upon the installation and depending upon the position of the switch housing 62, spatial separation A between the light housing 60 and the switch housing 62 may range from one or two feet to many feet (e.g. 10 feet).

Figures 4A, 4B:
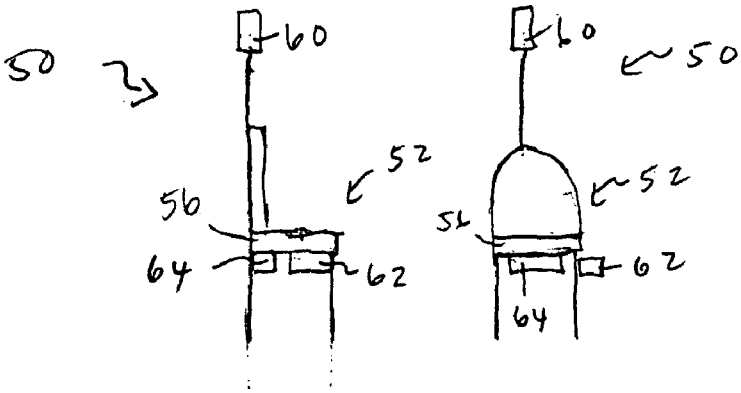
FIGS. 4A and 4B are side and back views, respectively, of a chair with a signal light mounted thereto.

In still other embodiments, the switch housing 62 may be operatively connected to the light housing 60 such that the switch housing 62 is easily accessible for a person sitting in the chair. For example, as shown in FIGS. 1 and 2, the switch housing 62 is connected to the support 66 so as to be positioned at or near the top of the back 54 of the chair 52. Accordingly, a person sitting in the chair 52 may reach up near his or her shoulder to access the switch housing 62. Alternatively, as shown in FIGS. 4A and 4B, the switch housing 62 may be mounted to chair 52 at or near a side of the seat 56. Accordingly, a person sitting in the chair 52 may reach down to his or her side to access the switch housing 62. This easily accessible positioning of the switch housing 62 minimizes dealer distraction in actuating the switch housing 62.

Figure 3:
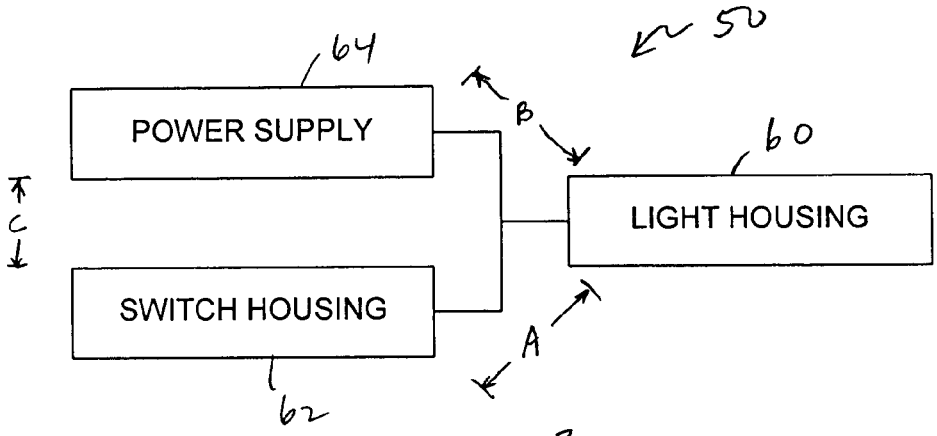
FIG. 3 is a schematic block diagram of a signal light of the invention.

In a number of embodiments, the power supply 64 is operatively connected to the light housing 60 and the switch housing 62 as shown in FIG. 3. The power supply 64 may be connected to the light housing 60 so that the power supply 64 is spatially separated from the light housing 60, which spatial separation is indicated by alpha B in FIGS. 2 and 3. In other embodiments, the power supply 64 may be connected to the switch housing 62 so that the power supply 64 is spatially separated from the switch housing 62, which spatial separation is indicated by alpha C in FIGS. 2 and 3. Accordingly, in contrast to convention lights in which separately functioning elements are included in a single device, the light 50 of the invention spatially separates the individual elements to maximize the convenience of the dealer and to minimize the distraction around the gaming table 58.

Figure 5:
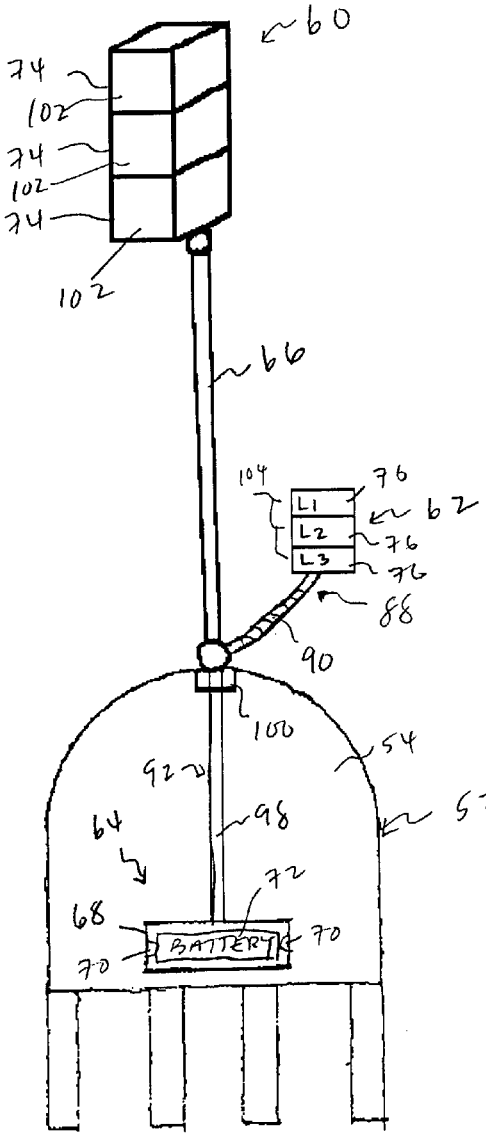
FIG. 5 is a schematic view of a signal light mounted to a chair.

With additional reference to FIG. 5, the power supply 64 may include a battery housing 68 with a pair of terminals 70 for respectively holding and connecting to a battery 72. In some of the embodiments, the battery housing 68 may be disposed at a rear of the chair 52 as shown in FIGS. 1, 2, and 5. In other embodiments, the battery housing 68 may be disposed below the seat 56 of the chair 52 as shown in FIGS. 4A and 4B. In still other embodiments, the power supply 64 may include an AC power source as an alternative to a battery housing.

Figure 6:
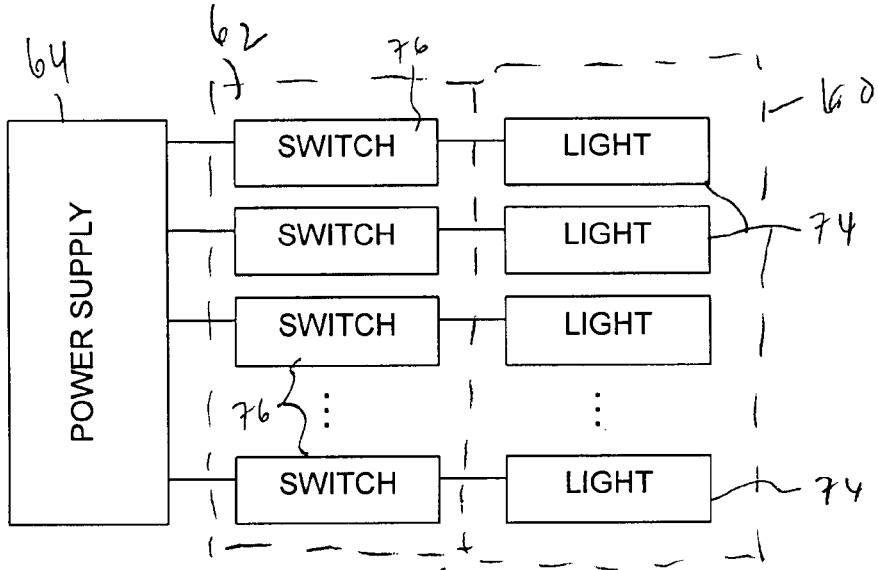
FIG. 6 is a schematic block diagram of a signal light of the invention.
Figure 7:
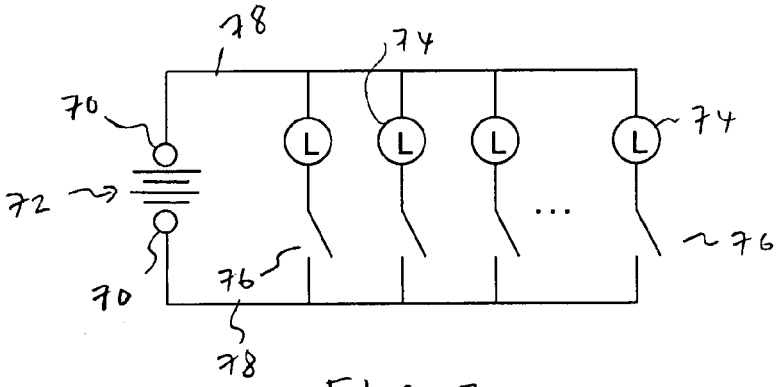
FIG. 7 is a schematic view of a signal light of the invention.

Referencing FIGS. 6 and 7, the light housing 60 may include a plurality of lights 74, and the switch housing 62 may include a plurality of switches 76 for respectively and selectively actuating the lights 74. Wiring 78 may electrically connect the terminals 70 of the power supply to the lights 74 and the switches 76.

Figure 8:
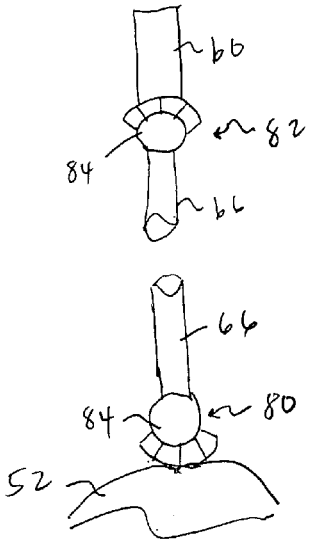
FIG. 8 illustrates mounting structure for a support of a light housing according to some of the embodiments.

In a number of embodiments, the support is configured so that the light housing 60 is positionable with respect to the chair 52. For example, as shown in FIG. 8, in some of the embodiments, a mounting structure 80 may be disposed at the end of the support 66 for mounting the support 66 to the chair 52. In other embodiments, a mounting structure 82 may be disposed at the other end of the support 66 for mounting the light housing 60 to the support 66. In either embodiment, the mounting structure 80 and 82 may include a pivoting mechanism 84 than enables the support 66 or the light housing 60 to be positioned with respect to the chair 52.

Figure 9:
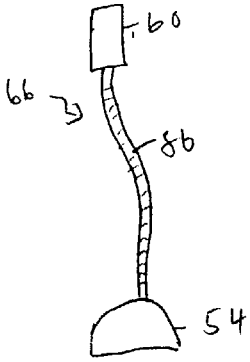
FIG. 9 illustrates a support for a light housing according to other embodiments.

In some of the embodiments, the pivoting mechanism 84 may include an indexed elbow hinge that enables the support 66 to be adjusted at discrete positions. Alternatively, the mounting elements 80 and 82 may provide for continuous adjustment. In still other embodiments such as that shown in FIG. 9, the support 66 is not rigid by may include an alligator-neck section 86 that enables positioning of the support 66 while retaining the support 66 in a desired position.

Similarly, in a number of embodiments the switch housing 62 may be positionable with respect to the chair 52. For example, as shown in FIG. 5, the switch housing 62 may include a connecting structure 90 for connecting the switch housing 62 to either the chair 52 or to the other elements of the light 50, e.g., the support 66 as shown. The connecting structure 90 may include an alligator-neck section 90 that enables the switch housing 62 to be positioned while retaining the switch housing 62 in a desired position.

Figure 10:
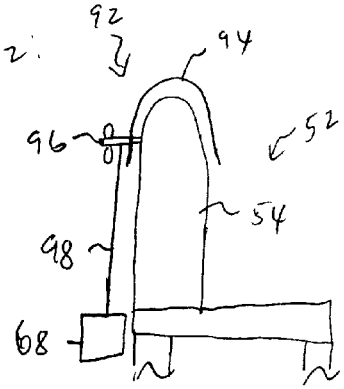
FIG. 10 schematically illustrates a mounting structure for a battery housing.

With reference to FIG. 10, a mounting structure 92 may be provided in some of the embodiments for mounting the battery housing 68 to the chair 52. The mounting structure 92 may include a bracket 94 that may be mounted on the top of the back 54 of the chair 52 with a clamp 96. The mounting structure 92 may include a strap 98 connected between the bracket 94 and the battery housing 68 so that the battery housing 68 is suspended at the rear of the chair 52.

Figure 11:
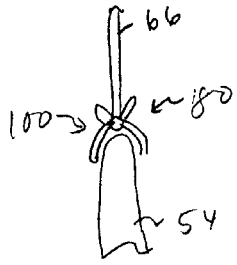
FIG. 11 schematically illustrates a mounting structure for a support.

As mentioned above, a mounting structure 80 may be provided in certain embodiments for mounting the support 66 to the chair 54. As shown in FIG. 11, the mounting structure 80 may include a clamp 100 for connecting or clamping to the top of the back 54 of the chair 52. Accordingly, in a number of embodiments an existing chair 52 in a casino may be retrofitted with the signal light 50 of the invention. Alternatively, the signal light 50 may be integrated with the chair 52 during manufacture.

Also as mentioned above, the light housing 60 may include a plurality of lights 74. In a number of embodiments, each of the lights 74 may be a different color. For example, the lights 74 may include a plurality of LEDs that each emits a different color light. Alternatively, as shown in FIG. 5, the light housing may include a plurality of colored windows 102 through which light from the plurality of lights 74 is respectively transmitted. For example, the light housing 60 may be configured so that virtually any color light may be transmitted, e.g., red, blue, white, amber, yellow, green, and so on. In multi-color embodiments, the switch housing 62 may include a plurality of indices 104 (indicated by L1, L2, and L3 in FIG. 5) respectively correlating the plurality of switches 76 with the plurality of lights 74.

In a commercial casino embodiment of the invention, the light 50 may include a power supply element that includes the battery housing 68 and the mounting structure 92; an elevated light element that includes the support 66, the light housing 60, and the mounting structure 80; a switching element that includes the switch housing 62 and the connecting structure 88; and an electrical system that includes the wiring 78 and other elements for ensure safe operation of the light 50.

Figure 12:
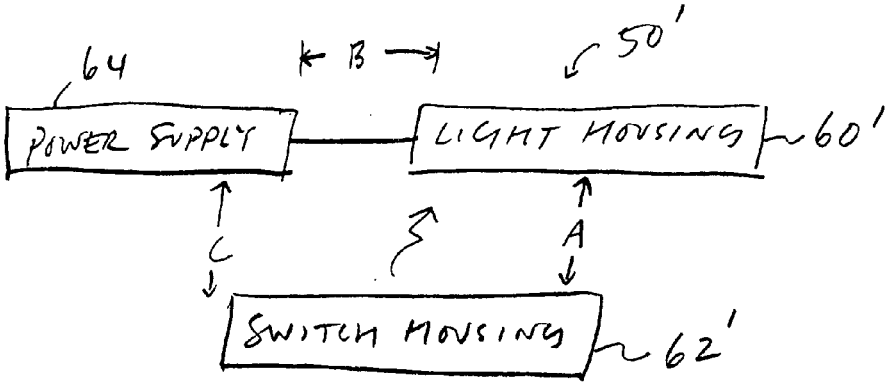
FIG. 12 is a schematic block diagram of a signal light according to some of the embodiments of the invention.

In contrast to hard-wired embodiments of the light 50 described above, according to a number of embodiments the light may be configured to be wireless and function on radio frequency principles. More particularly, as shown in FIG. 12, a signal light 50' includes a light housing 60' and a switch housing 62'. A power supply 64 may also be provided. The switch housing 62' is operatively connected to, that is, is in communication with, the light housing 60' such that the switch housing 62' is spatially separated the light housing 60'. In addition, the switch housing 62' may be moved and positioned with respect to the light housing 60'. The spatial separation of the housings 60' and 62' is indicated by alpha A. In the wireless embodiments of the invention, a person sitting in a chair can position the switch housing 62' at a convenient and easily accessible location.

Figure 13:
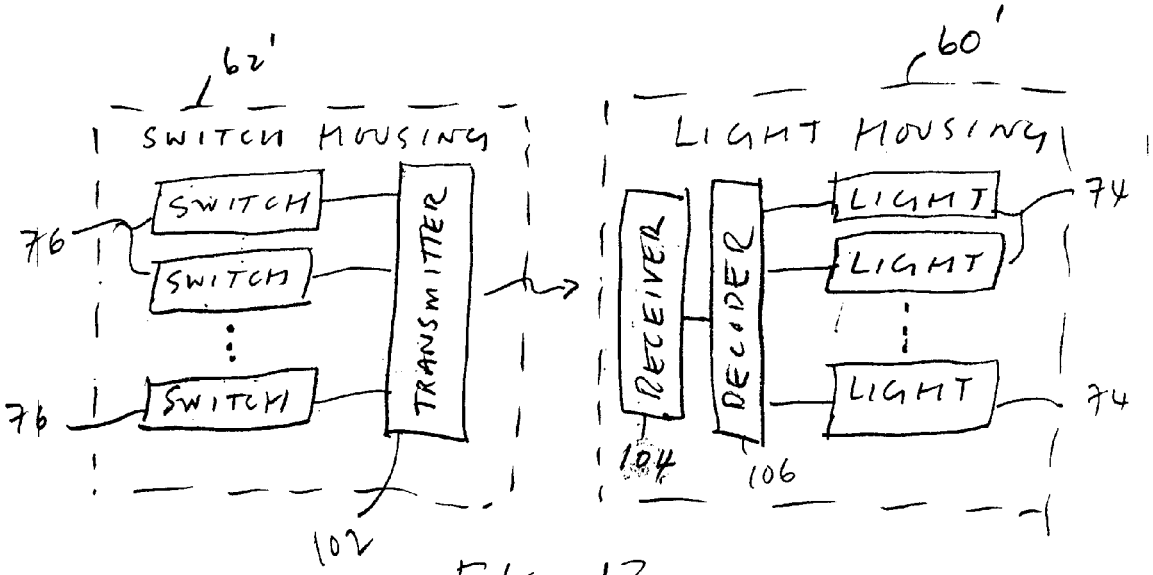
FIG. 13 is a schematic block diagram of a switch housing and a light housing according to a number of embodiments.

As shown in FIG. 13, the switch housing 62' may be configured as a remote control in many embodiments, including a plurality of switches 76 connected to a transmitter 102 with appropriate drive circuitry. Complementing the remote-control switch housing 62', the light housing 60' may include a receiver 104 with a decoder 106 for receiving the wireless signal from the switch housing 62'. The decoder 106 decodes the signal from the switch housing 62' and actuates the corresponding light 74. In embodiments in which a plurality of lights 50' are installed (e.g., a casino), the transmitter 102 of each switch housing 62' may be configured to operating on a unique frequency so that only the light housing 60' associated therewith is able to decode the signal.

Those skilled in the art will understand that the preceding embodiments of the present invention provide the foundation for numerous alternatives and modifications thereto. These other modifications are also within the scope of the present invention. Accordingly, the present invention is not limited to that precisely as shown and described in the present invention.

What is claimed is:

1. An easily-accessible multi-signal light for a chair positioned at a gaming table in a casino, the chair having a back and a seat, the light comprising:

a power supply element including:

a battery housing for holding a battery and having terminals for connecting to the battery; and a mounting structure for mounting to the chair and for mounting the battery housing to the chair such that the battery housing is disposed at a rear of the back of the chair;

an elevated light element including:

a support;

a light housing disposed at one end of the support and having a plurality of lights; and a mounting structure disposed at the other of the support for mounting the support to the chair such that the light housing is elevated above the chair;

a switching element including:

a switch housing having a plurality of switches for respectively and selectively actuating the plurality of lights; and a connecting structure connecting the switch housing to the power supply element and the elevated light element such that the switch housing is:

spatially separated from the battery housing of the power supply element and the light housing of the elevated light element; and easily accessible for a person sitting in the chair; and an electrical system including wiring connected to the terminals of the power supply element, the plurality of lights of the elevated light element, and the plurality of switches of the switching element.

2. The light of claim 1 wherein the elevated light element further includes a pivoting mechanism disposed between the mounting structure thereof and the support such that the light housing is positionable with respect to the chair.

3. The light of claim 2 wherein the pivoting mechanism includes an indexed elbow hinge.

4. The light of claim 1 wherein the elevated light element further includes a pivoting mechanism disposed between the light housing and the support such that the light housing is positionable with respect to the chair.

5. The light of claim 4 wherein the pivoting mechanism includes an indexed elbow hinge.

6. The light of claim 1 wherein the support of the elevated light element is not rigid such that the light housing is positionable with respect to the chair.

7. The light of claim 6 wherein the support includes an alligator-neck section.

8. The light of claim 1 wherein the mounting structure of the power supply element includes a clamp for connecting to a top of the back of the chair and a strap connected between the clamp and the battery housing.

9. The light of claim 1 wherein the mounting structure of the elevated light element includes a clamp for connecting to a top of the back of the chair.

10. The light of claim 1 wherein the switch housing is positionable with respect to the chair.

11. The light of claim 1 wherein each of the plurality of lights is a different color.

12. The light of claim 1 wherein the light housing includes a plurality of colored windows through which light from the plurality of lights is respectively transmitted.

13. The light of claim 1 wherein the switch housing includes indices respectively correlating the plurality of switches with the plurality of lights.

14. A chair for use by a gaming-table employee in a casino, the chair comprising:

a back; and a light including:

a battery housing for holding a battery and having terminals for connecting to the battery;

the battery housing being mounted to the chair such that the battery housing is disposed at a lower rear portion of the back of the chair;

a support having a light housing with a plurality of lights in electrical communication with the terminals;

the support being mounted to the chair such that the light housing is elevated above the chair; and a switch housing having a plurality of switches in electrical communication with the terminals and the plurality of lights;

the switch housing being spatially separated from the battery housing and the light housing and being easily accessible for a person sitting in the chair.

15. The chair of claim 14 wherein the support includes a mounting structure that is mounted to the chair, the mounting structure is configured such that the light housing is positionable with respect to the chair.

16. The chair of claim 14 wherein the light housing is connected to the support at a mounting structure that is configured such that the light housing is positionable with respect to the chair.

17. The chair of claim 14 wherein the switch housing includes a connecting structure that is configured to enable the switch housing to be positionable with respect to the chair.

18. The chair of claim 14 further comprising the battery connected to the terminals of the battery housing.

19. A signal light for a chair, the signal light comprising:

a light housing;

a support on which the light housing is disposed and being mounted to the chair such that the light housing is elevated above the chair; and a switch housing being operatively connected to the light housing such that the switch housing is spatially separated the light housing;

the switch housing including a connecting structure that is configured to enable the switch housing to be positionable with respect to the chair.

20. The signal light of claim 19 wherein the switch housing is operatively connected to the light housing such that the switch housing is easily accessible for a person sitting in the chair.

21. The signal light of claim 19 wherein:

the light housing includes a plurality of lights; and the switch housing includes a plurality of switches for respectively and selectively actuating the plurality of lights.

22. The light of claim 19 further comprising a power supply operatively connected to the light housing and the switch housing.

23. The light of claim 22 wherein the power supply is connected to the light housing such that the power supply is spatially separated from the light housing.

24. The light of claim 22 wherein the power supply is connected to the switch housing such that the power supply is spatially separated from the switch housing.

25. The light of claim 22 wherein the power supply includes a battery housing for holding a battery and having terminals for connecting to the battery.

26. The light of claim 25 wherein the battery housing is disposed at a rear of the chair.

27. The light of claim 25 wherein the battery housing is disposed below the seat of the chair.

28. The light of claim 19 wherein the switch housing is in wireless communication with the light housing.

29. The light of claim 28 wherein:

the switch housing includes a plurality of switches connected to a transmitter; and the light housing includes a receiver connected to a plurality of lights.

30. The light of claim 19 wherein the connecting structure is configured to enable the switch housing to be positionable with respect to the light housing.

* * * * *